US008182162B2

(12) United States Patent
Kuo et al.

(10) Patent No.: US 8,182,162 B2
(45) Date of Patent: May 22, 2012

(54) BARCODE LABEL RETENTION DEVICE OF BARCODE PRINTER

(75) Inventors: Shang-Shih Kuo, Yonghe (TW); Chin-Chuan Liu, Taipei (TW)

(73) Assignee: TSC Auto ID Technology Co., Ltd., I-Lan Hsien (TW)

( * ) Notice: Subject to any disclaimer, the term of this patent is extended or adjusted under 35 U.S.C. 154(b) by 566 days.

(21) Appl. No.: 12/382,586

(22) Filed: Mar. 19, 2009

(65) Prior Publication Data

US 2009/0238629 A1 Sep. 24, 2009

(30) Foreign Application Priority Data

Mar. 24, 2008 (TW) ..... 97205012 U

(51) Int. Cl.
*B41J 11/00* (2006.01)

(52) U.S. Cl. ..... 400/579; 400/619

(58) Field of Classification Search ..... 400/611, 400/579, 619

See application file for complete search history.

(56) References Cited

U.S. PATENT DOCUMENTS

| | | | | |
|---|---|---|---|---|
| 6,609,844 | B1 * | 8/2003 | Petteruti et al. | 400/88 |
| 6,695,500 | B2 * | 2/2004 | Kim et al. | 400/613 |
| 7,270,111 | B2 * | 9/2007 | Grybush et al. | 123/400 |
| 7,607,468 | B2 * | 10/2009 | Yamamoto et al. | 156/543 |
| 7,753,606 | B2 * | 7/2010 | Maekawa | 400/613 |
| 2007/0147936 | A1 * | 6/2007 | Ando et al. | 400/579 |

* cited by examiner

*Primary Examiner* — Seung Lee
*Assistant Examiner* — Christle Marshall
(74) *Attorney, Agent, or Firm* — Rosenberg, Klein & Lee

(57) ABSTRACT

A barcode label retention device is provided for a barcode printer. The barcode label retention device includes s at least one pair of label roll retainers, at least one pair of resilient elements, and at least one pair of fixing plates. The label roll retainers are mounted inside a housing of a barcode printer and spaced from each other to receive and retain a label roll therebetween. The resilient elements are arranged inside each label roll retainer, and the fixing plates are arranged inside each label roll retainer. The fixing plate is connected to the resilient element to provide the fixing plate with resiliency for inward depressibility or outward biasing so that a front portion of the fixing plate projects inwards beyond the label roll retainer to abut against opposite ends of the label roll, whereby the label roll can be securely held by the two fixing plates engaging the opposite ends thereof and the path of a winding/unwinding operation can be stabilized.

4 Claims, 6 Drawing Sheets

BARCODE LABEL RETENTION DEVICE OF BARCODE PRINTER

BACKGROUND OF THE INVENTION

1. Field of the Invention

The present invention relates to a barcode label retention device of a barcode printer, and in particular to a barcode label retention device that is applicable to a barcode printer and features a pair of resiliency-based fixing plates for stabilizing a scrolling/unwinding trace and/or operation of a label roll.

2. The Related Arts

A conventional barcode printer includes a label roll to be printed retained inside the barcode printer for feeding a printable label to a printing mechanism for carrying out printing operations. The barcode label retention device of the known barcode printer is incapable to stabilize the trace and/or operation of scrolling/unwinding of the label and thus the label roll, during an unwinding or scrolling process, may be subjected to away or shake, leading to shifting of position at the time when the barcode label enters the printing mechanism for carrying out printing and also causing potential problems of loss of focusing and occurrence of burring. Consequently, the printing quality deteriorates.

SUMMARY OF THE INVENTION

Due to the fact that the barcode label retention device of the known barcode printer is not capable to properly hold a barcode label roll and to stabilize the scrolling/unwinding trace and/or operation of the barcode label roll, the printing quality realized by the known barcode printer is substantially affected and deteriorated.

Thus, to overcome the above problems, the present invention is aimed to provide a barcode label retention device for a barcode printer, wherein the barcode label retention device comprises at least one pair of label roll retainers, at least one pair of resilient elements, and at least one pair of fixing plates. The label roll retainers are mounted inside a housing of a barcode printer and spaced from each other to receive and retain a label roll therebetween. The resilient elements are arranged inside each label roll retainer, and the fixing plates are arranged inside each label roll retainer. The fixing plate is connected to the resilient element to provide the fixing plate with resiliency for inward depressibility or outward biasing so that a front portion of the fixing plate projects inwards beyond the label roll retainer to abut against opposite ends of the label roll, whereby the label roll can be securely held by the two fixing plates engaging the opposite ends thereof and the path of a winding/unwinding operation can be stabilized.

The effectiveness of the barcode label retention device of a barcode printer in accordance with the present invention is that the barcode label roll is subjected to resilient clamping inside the barcode printer and the winding/unwinding trace of the barcode label roll can be stabilized to thereby ensure printing quality effected on the barcode label by the barcode label printer.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENTS

Figure 1:
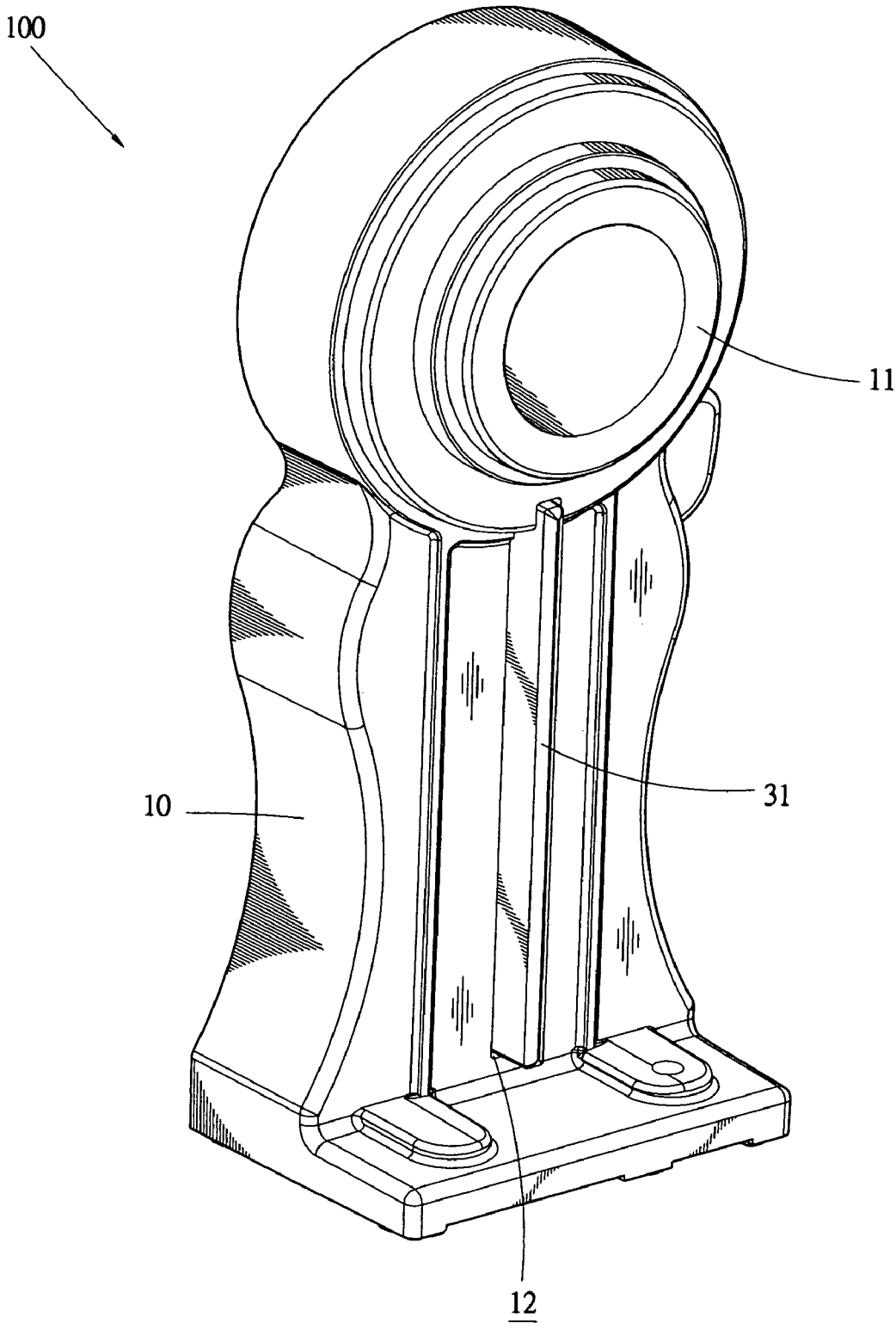
FIG. 1 is a perspective view showing a barcode label retention device constructed in accordance with a first embodiment of the present invention for use in a barcode printer.
Figure 2:
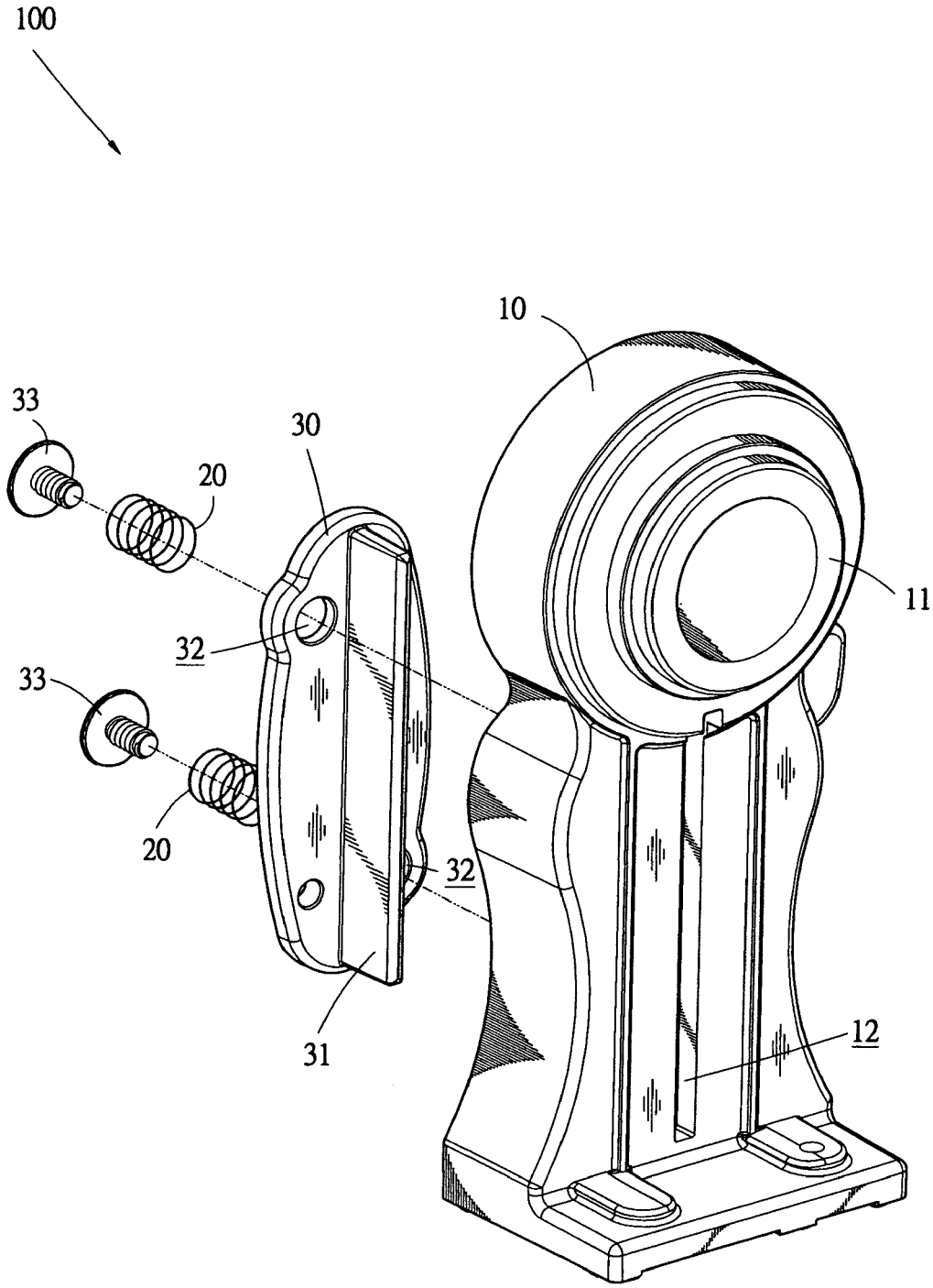
FIG. 2 is an exploded view of the barcode label retention device of FIG. 1.
Figure 5:
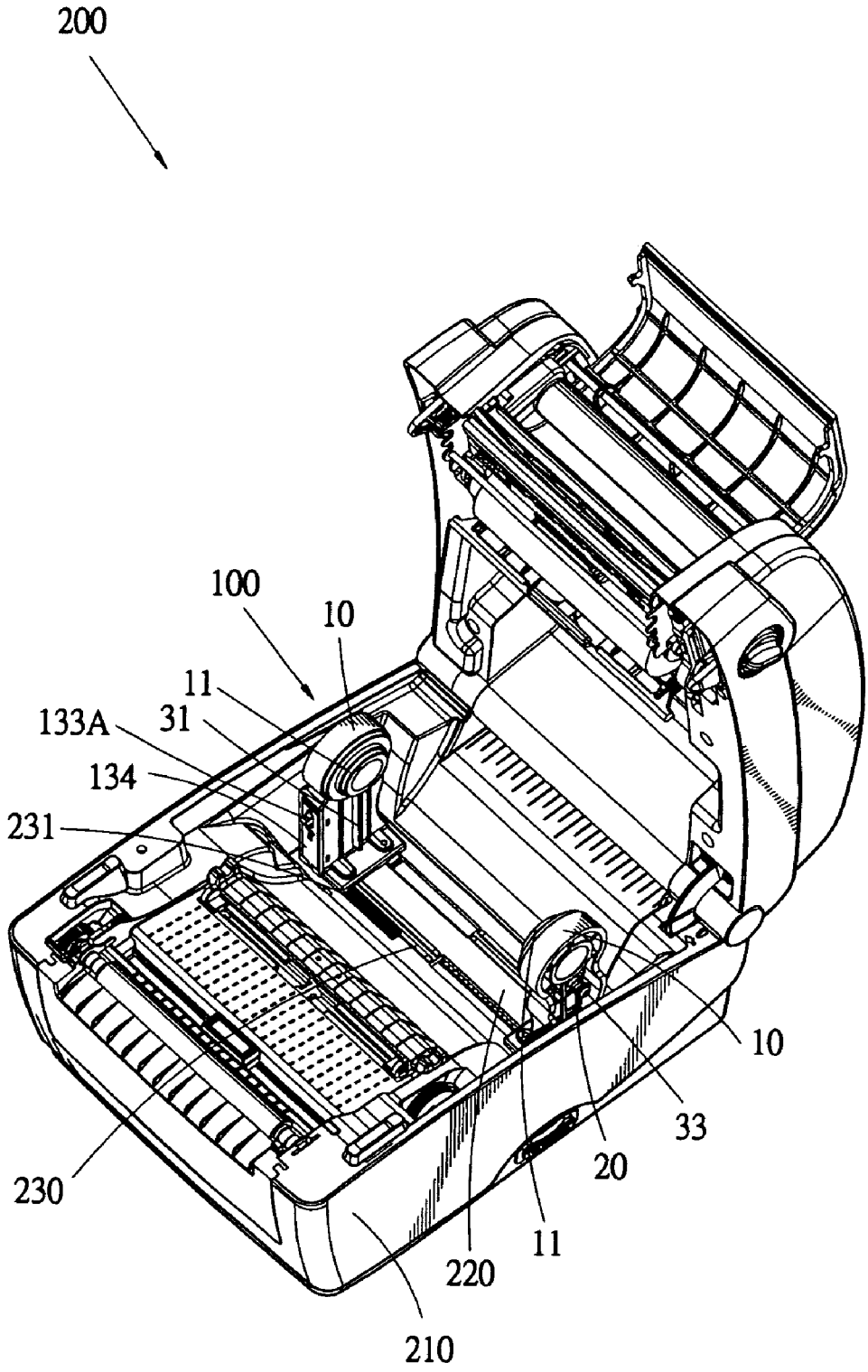
FIG. 5 is a perspective view illustrating an example of the application of the barcode label retention device of the present invention in a barcode printer.
Figure 6:
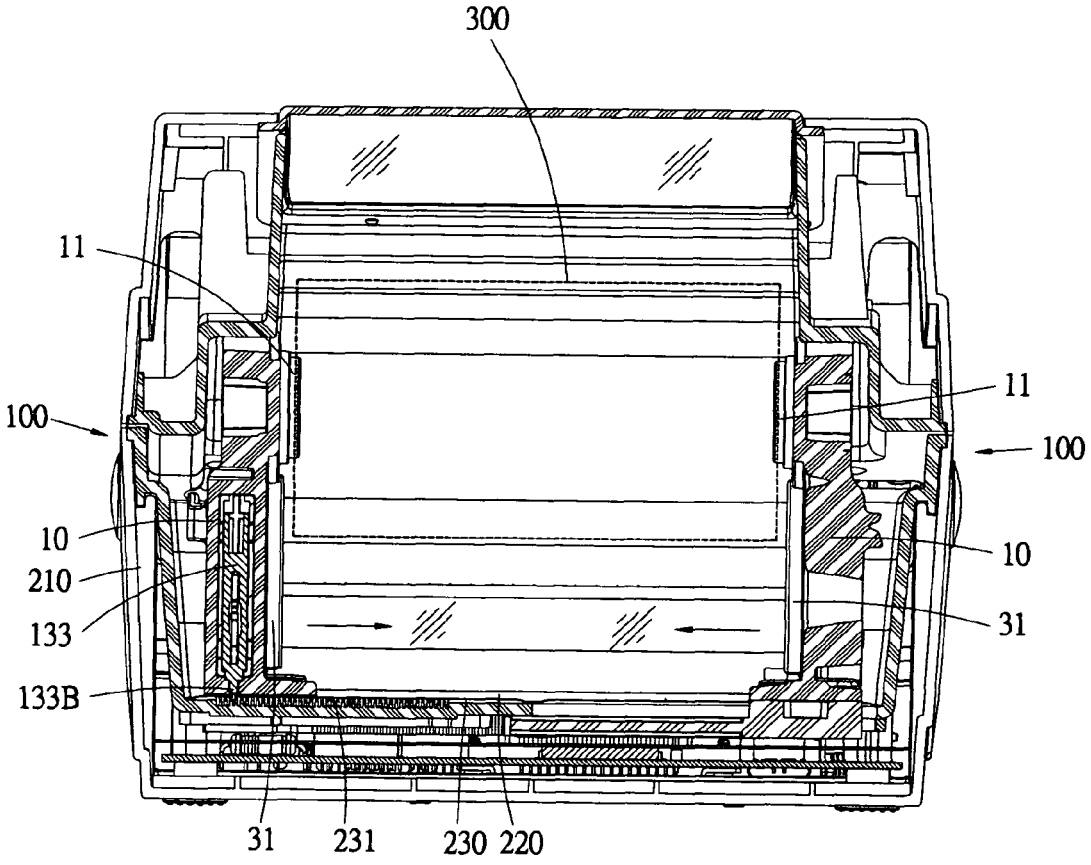
FIG. 6 is side elevational view illustrating fixing plates of the barcode label retention device of the present invention subjected to spring forces induced by resilient elements to stabilize a scrolling/unwinding trace and/or operation of a barcode label roll.

With reference to the drawings and in particular to FIGS. 1 and 2, a barcode label retention device constructed in accordance with a first embodiment of the present invention, generally designated at 100, is provided for a barcode printer, which is designated with reference numeral 200 as shown in FIGS. 5 and 6. The barcode label retention device 100 comprises at least one pair of label roll retainers 10, which are arranged inside a housing 210 of the barcode printer 200. The label roll retainers 10 each have a top portion having an inside surface opposing each other and forming at least one axle 11, whereby a label roll 300 (see FIG. 6) can be received in a space between the label roll retainers 10 with ends of the label roll 300 fit over the axles 11 respectively. Each label roll retainer 10 has a lower portion having an inside surface in which a slit 12 that extends through the label roll retainer 10 in a direction substantially parallel to the axles 11 is defined.

At least one resilient element 20 is arranged inside the label roll retainer 10. The resilient element 20 is not limited to any specific form and, in the embodiment illustrated, comprises a spring. At least one fixing plate 30 is also received in the label roll retainer 10 and forms on a front face thereof a rib 31 and also forms at least one pair of fastening holes 32 on opposite side portions thereof. The rib 31 extends beyond the inside surface of the label roll retainer 10 through the slit 12. The fastening holes 32 respectively correspond to and engage with the resilient elements 20 and are fixed to an inside wall of the label roll retainer 10 by two bolts 33 that respectively extend therethrough, whereby the fixing plate 30 and the rib 31 are provided with compressible resiliency due to the resilient elements 20.

Figure 3:
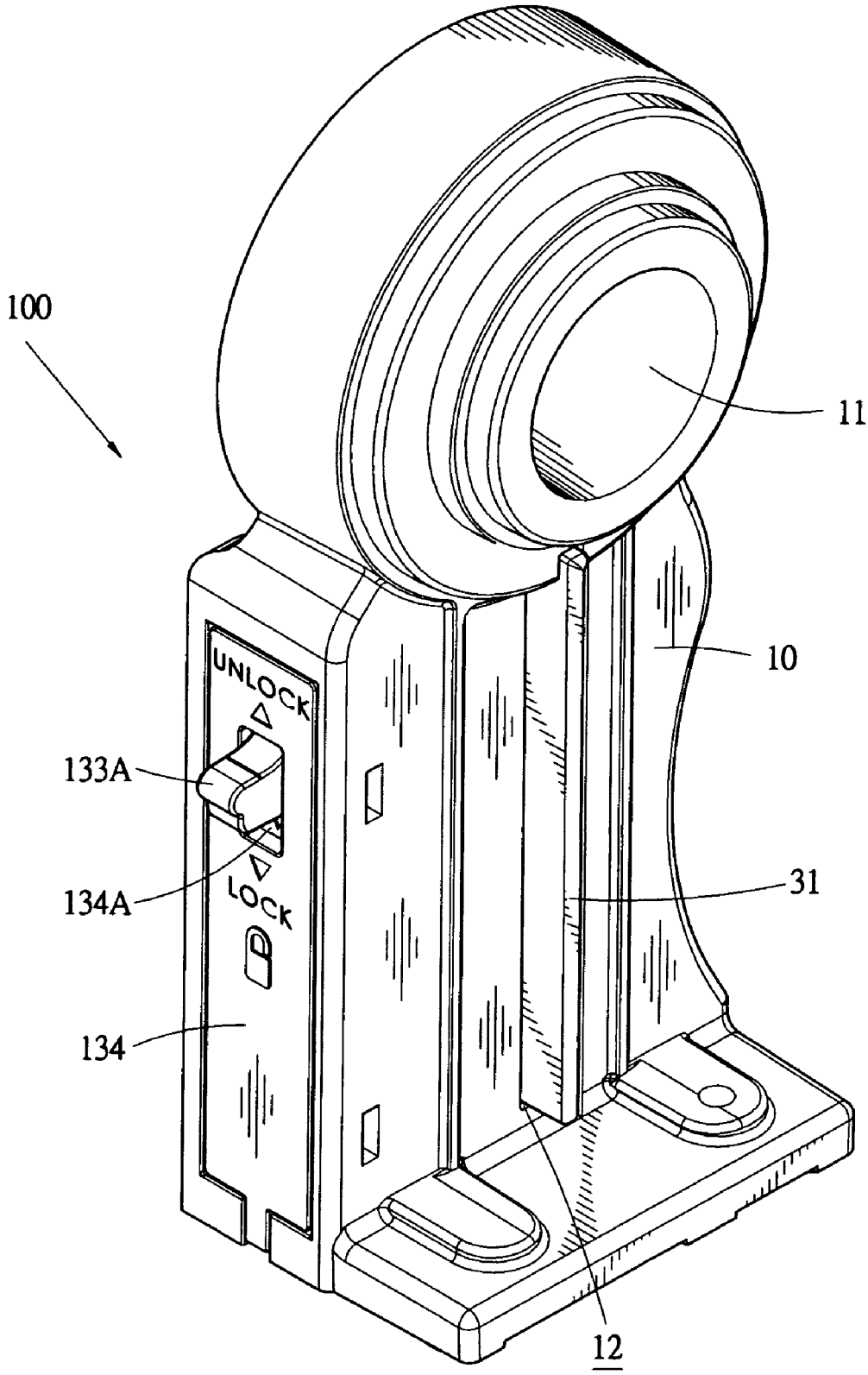
FIG. 3 is a perspective view showing a barcode label retention device constructed in accordance with a second embodiment of the present invention for use in a barcode printer.
Figure 4:
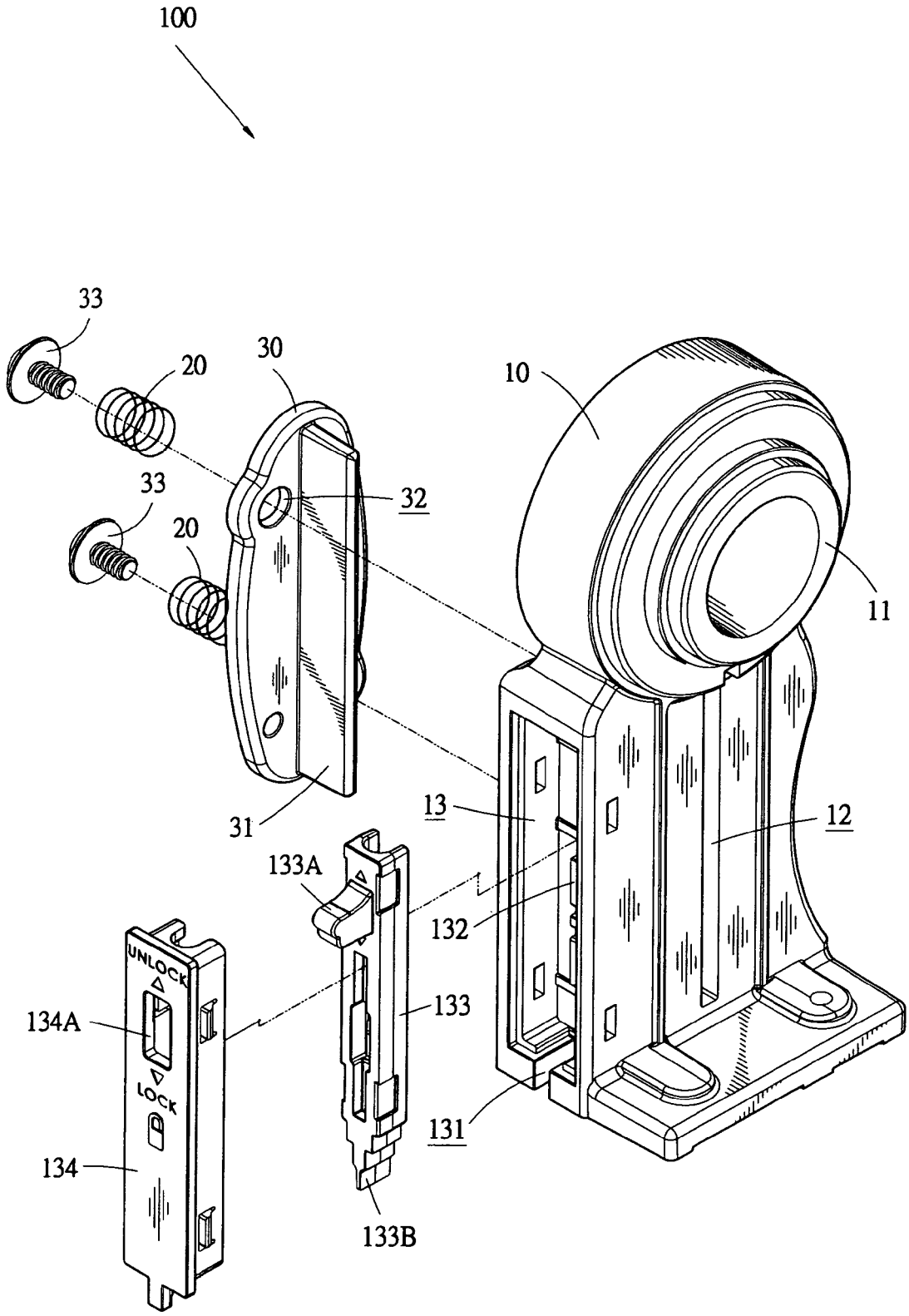
FIG. 4 is an exploded view of the barcode label retention device of FIG. 3.

Reference is now made to FIGS. 3 and 4. A barcode label retention device constructed in accordance with a second embodiment of the present invention is shown and is also designated with reference numeral 100 for simplicity. The barcode label retention device 100 of the second embodiment similarly comprises label roll retainers 10, each having a side surface forming at least one accommodation chamber 13 that is partly delimited by a lower wall in which a projection notch 131 is formed. A guide rail 132 is formed inside the accommodation chamber 13. A positioning plug 133 is received in the accommodation chamber 13 and is movably fit over the guide rail 132. An operation handle 133A is formed on one surface of the positioning plug 133 and a locking section 133B is formed on a lower end of the positioning plug 133. The positioning plug 133 can be operated by depressing down the operation handle 133A to have the locking section 133B projecting out of the projection notch 131 of the label roll retainer 10, or the operation handle 133A of the positioning plug 133 can be pulled upward to withdraw the locking section 133B back into concealment within the accommodation chamber 13 of the label roll retainer 10. The accommodation chamber 13 is also provided with a face panel 134, which selectively closes and seals the accommodation chamber 13. The face panel 134 forms an operation opening 134A, whereby the operation handle 133A of the positioning plug 133 projects out of the accommodation chamber 13 through the operation opening 134A of the face panel 134.

Also referring to FIGS. 5 and 6, an example of application of the barcode label retention device 100 of the present invention is illustrated; and particularly the barcode label retention device 100 of FIG. 4 is shown incorporated in a barcode printer 200. Inside a housing 210 of the barcode printer 200, a slide rail 220 and a positioning rail 230 are fixed and substantially parallel to each other. The positioning rail 230 has a surface forming a series of raised teeth 231. The two label roll retainers 10 are provided at bottoms thereof with mounting portions slidably mounted to the slide rail 220 and the label roll retainer 10 are thus allowed to slide along the slide rail 220 to have the barcode label roll 300 fit to and securely held by the axles 32 of the label roll retainers 10. The operation handles 133A of the positioning plugs 133 of the two label roll retainers 10 are then depressed down to have the locking sections 133B of the positioning plugs 133 projecting outward to engage the teeth 231 of the positioning rail 230 whereby the barcode label roll 300 is securely held between the two label roll retainers 10. Further, with the ribs 31 of the fixing plates 30 of the label roll retainers 10 set in resilient abutment against opposite ends of the barcode label roll 300 (as indicated by arrows of FIG. 6), the scrolling/unwinding trace and/or operation can be made stable to thereby ensure the printing quality of the barcode printer 200.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A barcode label retention device for a barcode printer comprising:

at least one pair of label roll retainers for mounting inside a housing of a barcode printer, the pair of label roll retainers having top portions with respective inside surfaces opposing one another and configured to receive and retain a label roll therebetween, each label roll retainer having a bottom portion longitudinally spaced from the top portion thereof forming a mounting portion and a lower portion disposed intermediate the top and bottom portions, the lower portion having an inside surface with a longitudinally extended slit formed therethrough, each label roll retainer having a longitudinally extended accommodation chamber that has a projection notch formed through a lower end thereof and a longitudinally extended guide rail formed inside the accommodation chamber;

at least one pair of positioning plugs respectively received in the accommodation chambers of the label roll retainers and being longitudinally displaceable therein, each positioning plug having a U-shaped cross-sectional contour to define a longitudinally extended slotted opening therein, the longitudinally extended slotted opening of the positioning plug being fit over a corresponding guide rail, each positioning plug further having an operation handle extending laterally therefrom and a locking section formed at a longitudinal end thereof and disposed in correspondence with the projection notch of a corresponding accommodation chamber;

at least one pair of face panels forming respective closures for the accommodation chambers of the label roll retainers, each face panel having an operation opening formed therethrough and through which the operation handle of a corresponding positioning plug extends and is longitudinally displaceable therein;

at least one pair of fixing plates arranged inside the label roll retainers, each fixing plate having a front face with a longitudinally extended rib projecting therefrom to extend through the slit of a corresponding label roll retainer; and at least two pairs of resilient elements, each pair of resilient elements being mounted to a respective one of the label roll retainers for biasing a corresponding fixing plate rib through the slit thereof to resiliently abut and thereby hold the label roll between the label roll retainers.

2. The barcode label retention device as claimed in claim 1, wherein the inside surface of the top portion of each label roll retainer comprises an axle, each axle having a stepped contour.

3. The barcode label retention device as claimed in claim 1, wherein the resilient elements comprise springs.

4. The barcode label retention device as claimed in claim 1, wherein each fixing plate has at least one pair of fastening holes formed therethrough in spaced relationship and through which a pair of fasteners extend to secure a respective pair of the resilient elements in biasing relationship therewith.

* * * * *